US007959527B1

(12) United States Patent
Pitre

(10) Patent No.: US 7,959,527 B1
(45) Date of Patent: Jun. 14, 2011

(54) BALL HITTING PRACTICE ASSEMBLY WITH ACOUSTIC RETURN MECHANISM

(76) Inventor: Ken Pitre, Arnaudville, LA (US)

( * ) Notice: Subject to any disclaimer, the term of this patent is extended or adjusted under 35 U.S.C. 154(b) by 0 days.

(21) Appl. No.: 12/229,037

(22) Filed: Aug. 18, 2008

(51) Int. Cl.
*A63B 69/00* (2006.01)

(52) U.S. Cl. ..... 473/430; 473/422; 473/423; 473/429; D21/719

(58) Field of Classification Search ..... 473/422, 473/423, 417, 429, 430, 427
See application file for complete search history.

(56) References Cited

U.S. PATENT DOCUMENTS 3,006,647 A * 10/1961 Haskett ..... 473/429
3,593,998 A * 7/1971 Pattyn ..... 473/430
3,994,494 A * 11/1976 Kelley ..... 473/430
4,647,042 A * 3/1987 Bruce ..... 473/430
4,706,964 A * 11/1987 Genovese ..... 473/575
4,828,262 A * 5/1989 Henley ..... 473/429
4,993,709 A * 2/1991 Tominaga ..... 473/430
5,098,094 A * 3/1992 Kita ..... 473/423
5,467,978 A * 11/1995 Paluch ..... 473/429
6,086,488 A * 7/2000 Sanders ..... 473/423
2006/0035730 A1 * 2/2006 Nguyen ..... 473/417

* cited by examiner

*Primary Examiner* — Mitra Aryanpour
(74) *Attorney, Agent, or Firm* — Jacques Pierce Soileau

(57) ABSTRACT

A ball hitting practice assembly with acoustic return mechanism is provided for use by a ball hitter. The ball hitting practice assembly includes a rigid vertical shaft, having a first and second end; a weighted and/or anchored base coupled to the vertical shaft at said shaft's second end; a rigid horizontal shaft, having a first and second end, coupled at its first end to the vertical shaft's first end; a ball which is suspended from a cord, having a first and second end, said first end being attached to the horizontal shaft's second end, said ball being attached to said cord's second end; and a horizontal acoustic return mechanism that sounds when struck by the ball in practice of the present invention and then returns the ball to the hitter after each hit.

1 Claim, 7 Drawing Sheets

BALL HITTING PRACTICE ASSEMBLY WITH ACOUSTIC RETURN MECHANISM

BACKGROUND OF THE INVENTION

The disclosed invention is a ball hitting practice assembly. While there are known devices that suspend a ball from a rope or rigid member used for practice, none of said practice devices incorporate the qualities of sound as a function of success. Further, many of the known devices substantially limit the free motion of the ball such that the natural trajectory of the ball is lost. Further, many of the known devices do not accommodate for the varying height and dexterity of different users. The disclosed invention, in practice, simulates the natural trajectory of a ball when hit, and the natural trajectory of a pitch on return. It also provides a mechanism whereby the quality of the user's hit is indicated through a correlating sound. None of the current inventions combine all of these features to maximize both the physical and psychological effect of ball practice.

It is therefore desirable to provide a simple ball hitting practice assembly that can simulate the natural trajectory of various pitches. It is also desirable to provide a ball hitting practice assembly that can simulate the natural trajectory of a ball when hit. It is further desirable to provide a ball hitting practice assembly that features a mechanism which emits a sound indicating the quality of each hit. It is also desirable to provide an easily assembled and disassembled ball hitting practice assembly that can be efficiently transported. It is further desirable to provide a ball hitting practice assembly that may be substantially lean and lightweight when assembled so as not to detract from the hitting experience, and which may be adjusted to accommodate for the different physical features of various users.

SUMMARY OF THE INVENTION

It is therefore an object of this invention to provide a ball hitting practice assembly that is capable of simulating a variety of pitch trajectories which a ball hitter may experience in play.

It is another object of this invention to provide a ball hitting practice assembly that is capable of simulating the natural trajectory of a ball when hit in play.

It is also an object of this invention to provide a ball hitting practice assembly that is capable of emitting a sound to the user indicating the quality of each hit.

It is a further object of this invention to provide a ball hitting practice assembly that may be easily assembled, disassembled, transported, and/or permanently fixed in a desired location.

It is yet another object of this invention to provide a ball hitting practice assembly that may be substantially lean and lightweight when assembled so as not to detract from the hitting experience, and which can be adjusted to accommodate for the different physical features of various users.

It is still another object of this invention to provide a ball hitting device that includes a return mechanism so that the ball is deflected and returns to the user after each hit.

In accordance with this invention, a ball hitting practice assembly is provided comprising a rigid vertical shaft having a first and second end that is coupled at its second end to a weighted and/or anchored base. A rigid horizontal shaft that has a first and second end is coupled at its first end to the vertical shaft at its first end. A cord, having a first and second end is tethered at its first end to the horizontal shaft at its second end. A ball is tethered to the cord at its second end. A horizontal acoustic ball return mechanism having a first and second end is coupled at its first end to the vertical shaft at its first end.

Methods for making and using the ball hitting practice apparatus are also provided.

DETAILED DESCRIPTION OF THE INVENTION

In order that the invention herein described may be fully understood, the following detailed description is set forth.

Figure 1:
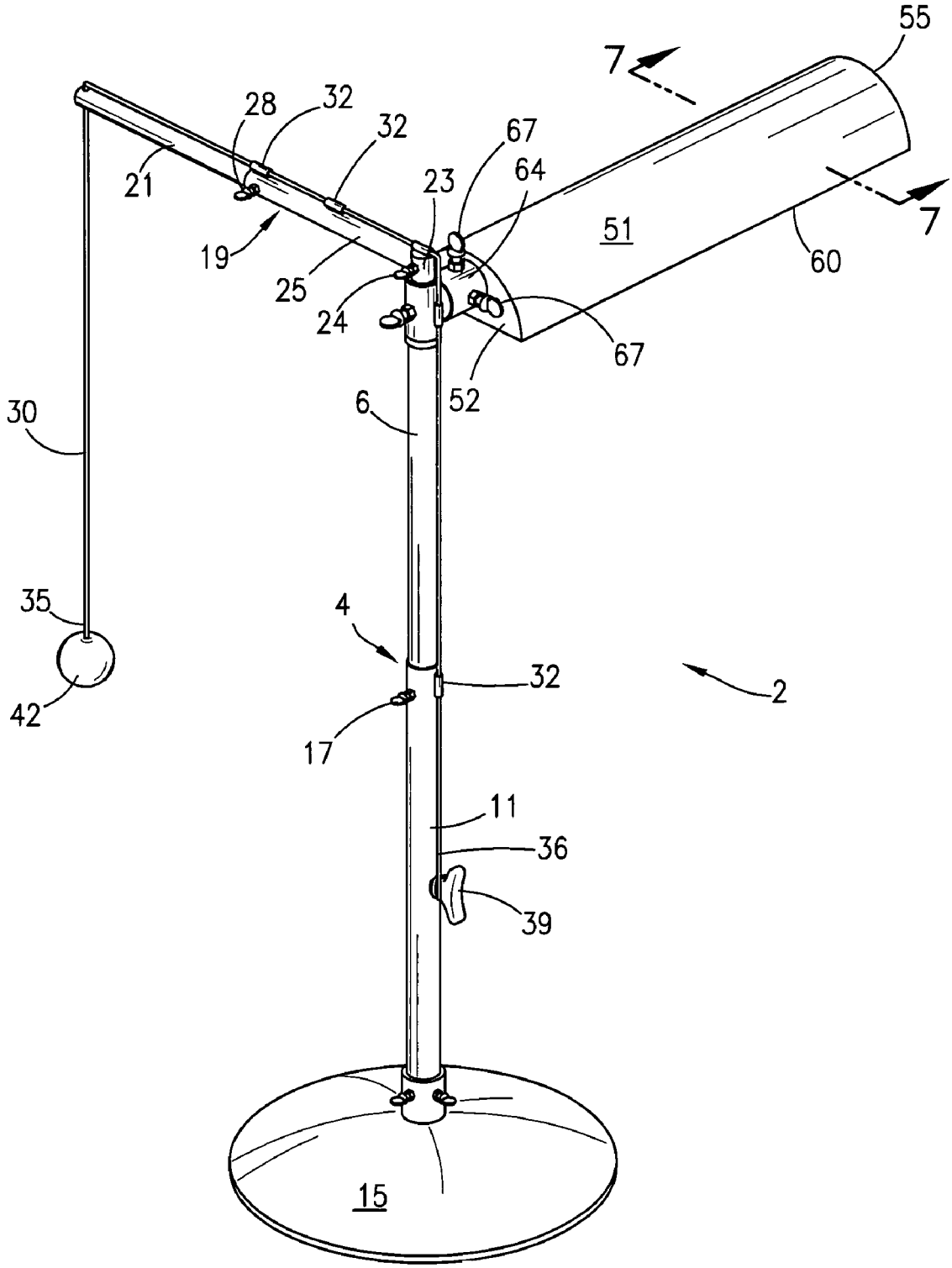
FIGS. 1-2 are perspective views of an illustrative embodiment of a ball hitting practice assembly with acoustic return mechanism according to the present invention.
Figure 4:
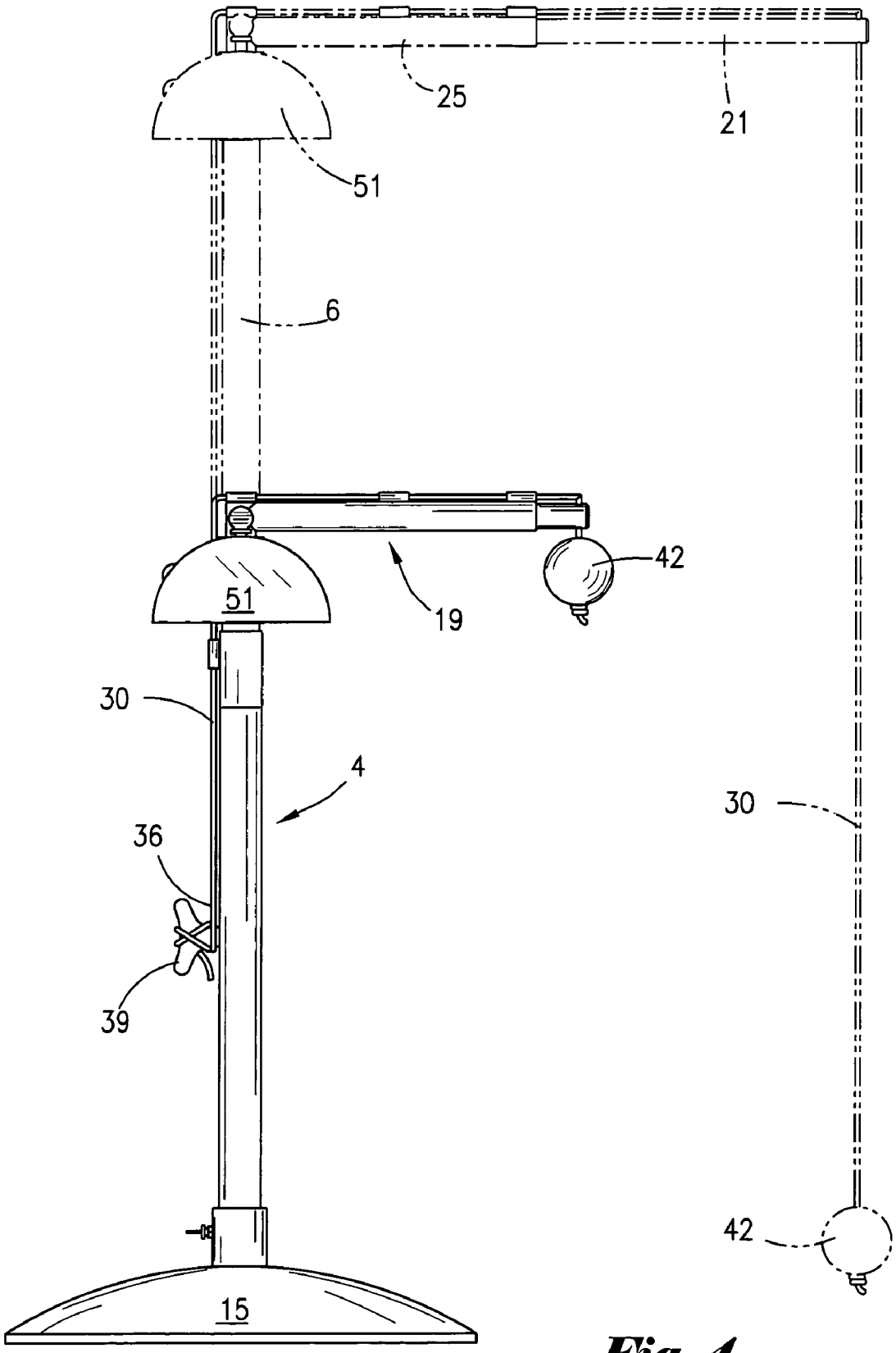
FIG. 4 is a functional view of an illustrative embodiment of a ball hitting practice assembly with an acoustic return mechanism according to the present invention.

FIG. 1 shows a ball hitting practice assembly 2 comprising a rigid vertical shaft 4 having a first end 6 and second end 11, said vertical shaft 4 being coupled at its second end 11 to a weighted basal anchor 15. The vertical shaft 4 may consist of a telescopic clamping component 17 such that said vertical shaft's 4 length may be adjusted. A rigid horizontal shaft 19 having a first end 25 and a second end 21 is coupled at said horizontal shaft's first end 25, to the vertical shaft's 4 first end 6 through the use of a hub mechanism 23, such that said horizontal shaft 19 can rotate 360° around the vertical shaft 4. A clamping device 24 can be used to tighten or lock the horizontal shaft 19 into a desired position. The vertical and horizontal shafts 4, 19 of the practice assembly 2 may be composed of lightweight materials such as metal, conduit, fiberglass, or plastic. The horizontal shaft 19 may consist of a telescopic clamping component 28 such that said horizontal shaft's 19 length may be adjusted. A flexible cord 30 having a first end 35 and second end 36 is tethered at said cord's 30 first end 36 to the vertical shaft 4 at said vertical shaft's 4 second end 11. The cord 30 may be tethered (FIG. 4) by wrapping said cord's second end 36 around a cord dock 39 such that said cord's 30 length may be adjusted relative to the ground below.

FIG. 1, A ball 42 is tethered to the cord 30 at said cord's second end 35 such that the ball 42 hangs vertically from the horizontal shaft 19.

Figure 5:
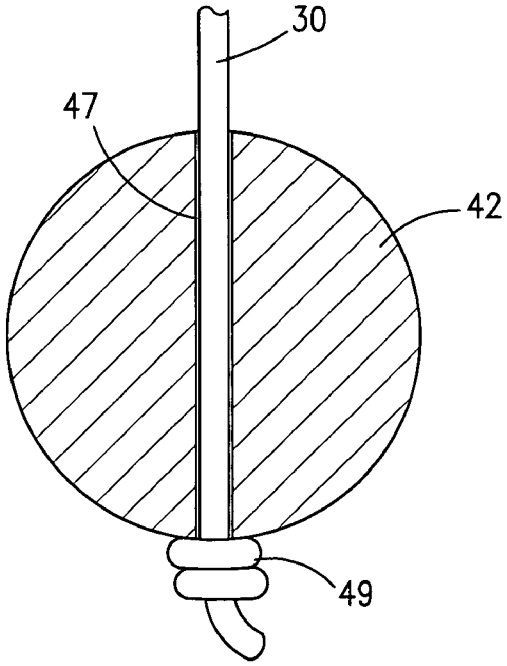
FIGS. 5-7 are cross-sectional views of illustrative ball attachments that may be used to fasten a cord to a ball according to the present invention.
Figure 6:
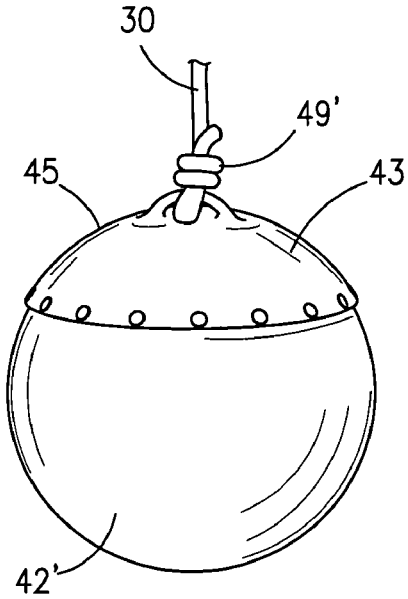
Figure 7:
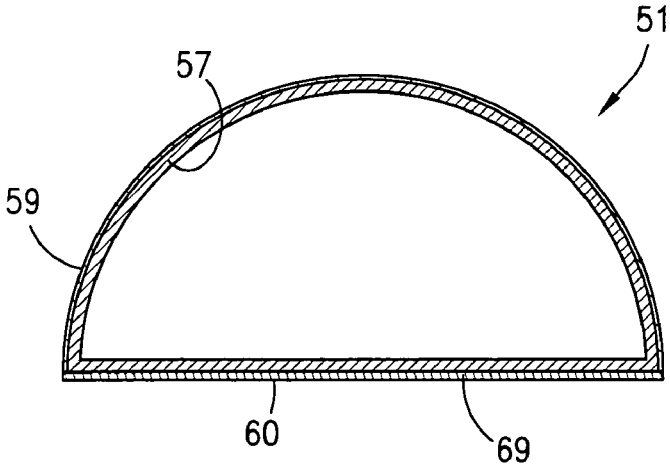

FIG. 5-7, The ball 42 may be attached to the cord in a variety of manners, which may include (FIG. 6) a mounting apparatus 43 on the top spherical surface 45 of the ball 42, or through (FIG. 5) a vertical hole 47 in the ball 42 such that the first end (FIG. 1) 35 of the cord 30 may be inserted through the top of the hole 47, threaded out through the bottom of said hole 47, and a knot 49 may be formed at the bottom end of said hole 47 to secure the ball 42 to the cord 30.

Figure 2:
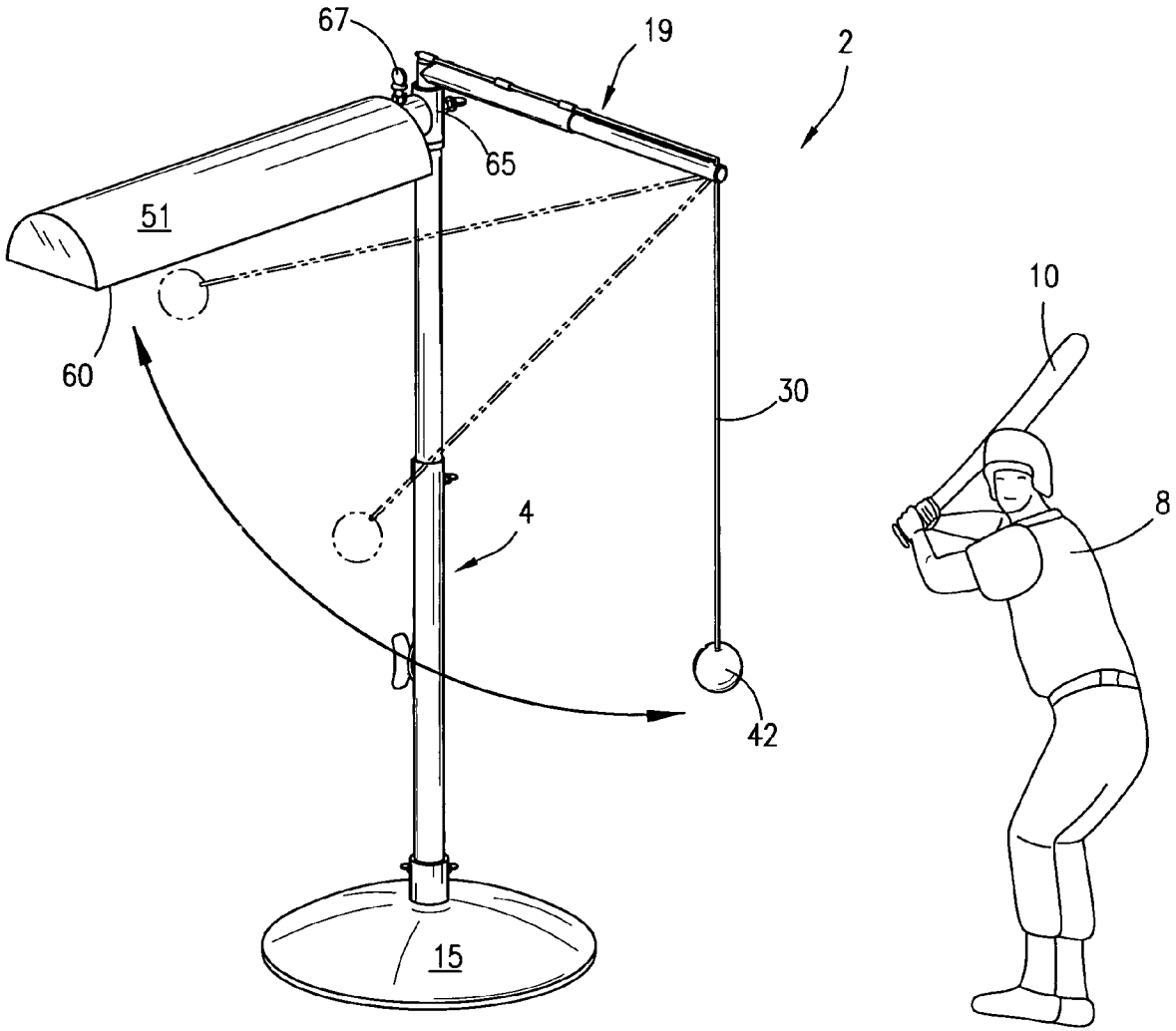

FIG. 2, A rigid horizontal acoustic ball return mechanism 51, having a first end 52 and a second end 55, that is coupled at said return mechanism's first end 55, to the first end 6 of the vertical shaft 4.

FIG. 2,3, The frame of the ball return mechanism 51 may be composed of lightweight material such as fiberglass, metal, conduit, or wood, and may be encased in thin sheets of plastic, metal, wood or other solid material. The return mechanism 51 may be in the shape of a semi-cylinder, with one planar surface 60.

Figure 3:
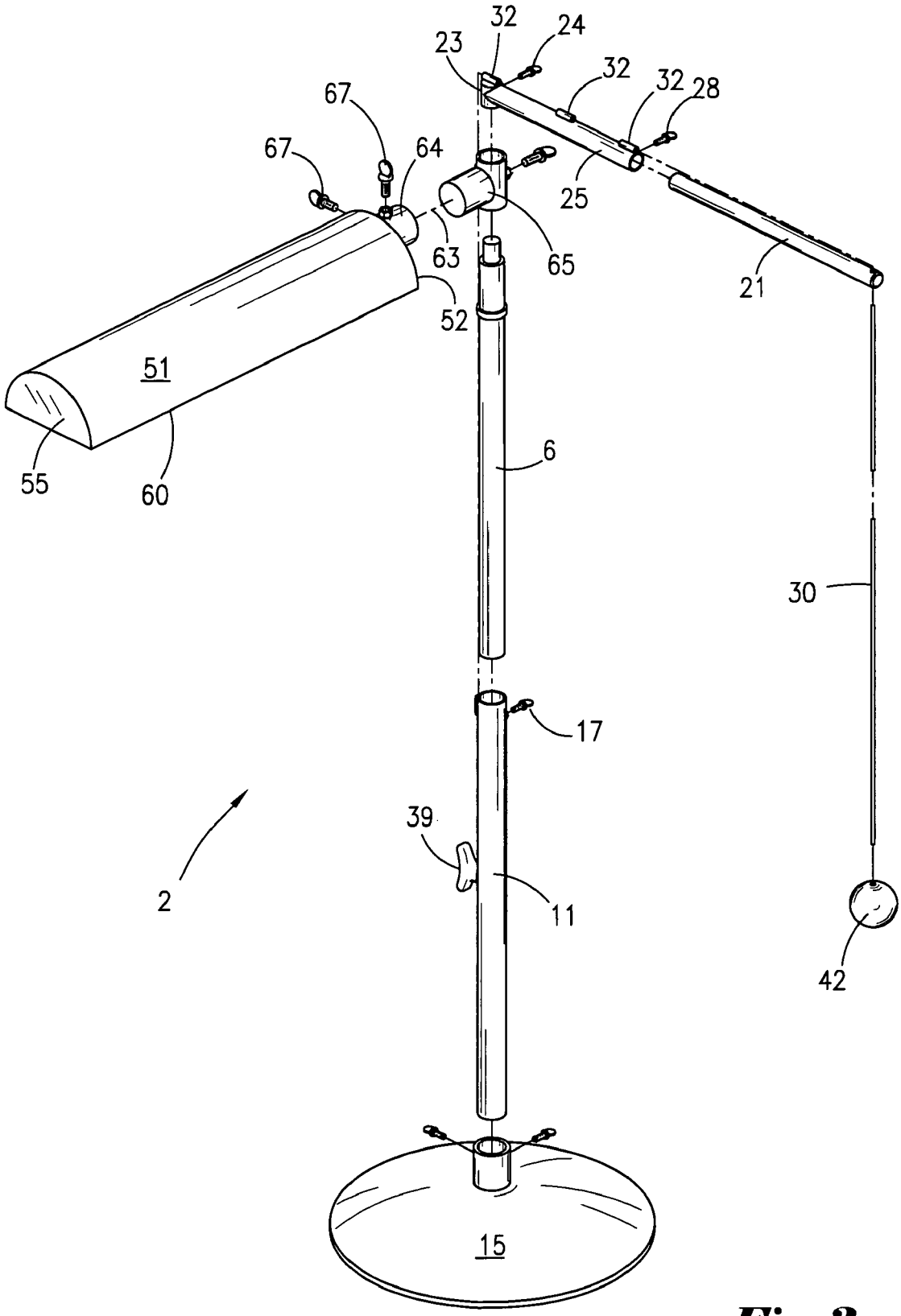
FIG. 3 is a constructive view of an illustrative embodiment of a ball hitting practice assembly with an acoustic return mechanism according to the present invention.

FIG. 3, The first end 52 of the semi-cylinder return mechanism 51 that is attached to the vertical shaft 4, may be attached to said vertical shaft 4 at said semi-cylinder return mechanism's center 64, such that said semi-cylinder return mechanism 51 can rotate 360° about its horizontal axis. A clamping device is provided 67, that allows the user to lock the return mechanism 51 into a desired position.

FIG. 1, The entire ball return mechanism 51 may be attached to the vertical shaft 4 through the use of (FIG. 3) a hinging mechanism 65, such that said return mechanism 51 may rotate 360° horizontally around said vertical shaft 4.

FIG. 2, The planar surface 60 of the return mechanism 51 may be covered with solid sheet material such as wood, metal, or plastic, such that the return mechanism 51 may emit a sound when the ball 42 strikes the planar surface 60 of the return mechanism 51.

FIG. 3, The return mechanism's 51 second end 55 may be capped off or left open to facilitate desired sound quality.

FIGS. 1-4, The flexible cord 30 may be comprised of plastic, low elasticity rubber, nylon, cotton, rope, or any other reasonably flexible material.

Figure 11:
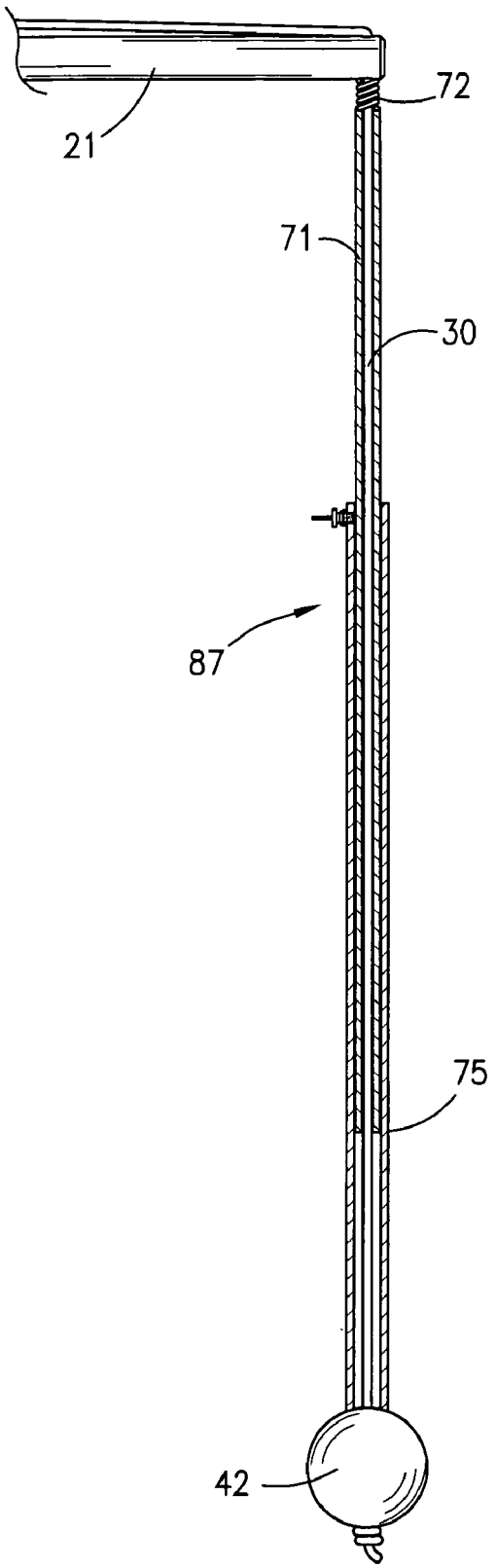
FIG. 11 is a perspective view of an illustrative embodiment of a rigid telescopic cylindrical casing that encases the cord shown in FIG. 1 of the present invention.

FIG. 11, The cord 30 may be made substantially rigid by encasing said cord 30 with a rigid telescopic cylindrical casing component 87, having a first end 71 and a second end 75. Said rigid telescopic casing 87 may be coupled at its first end 71 to the horizontal shaft's second end 21 through the use of a spring controlled hinging mechanism 72. Said spring controlled hinging mechanism 72 may control and guide the return of the ball 42 to the user after each hit.

Figure 8:
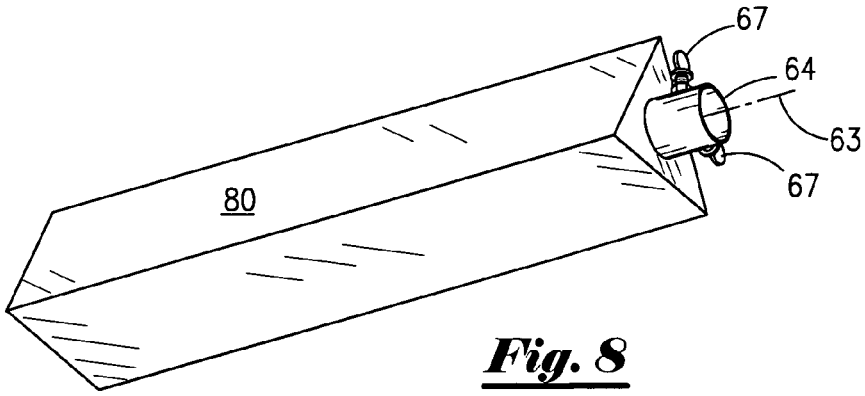
FIGS. 8-10 are perspective views of alternative illustrative embodiments of acoustic return mechanisms according to the present invention.
Figure 9:
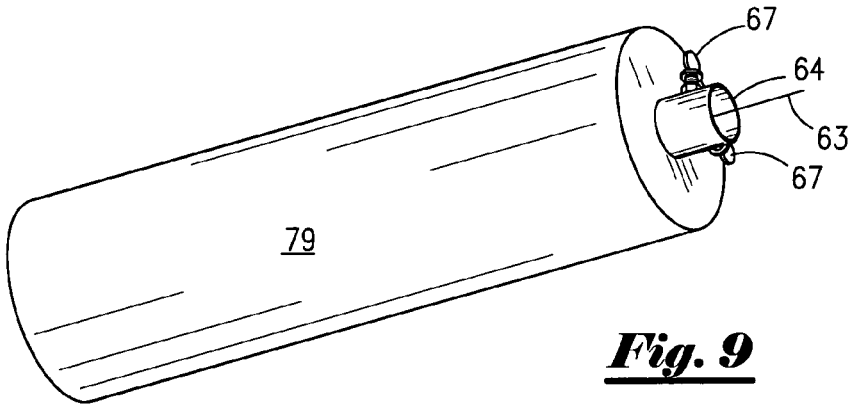
Figure 10:
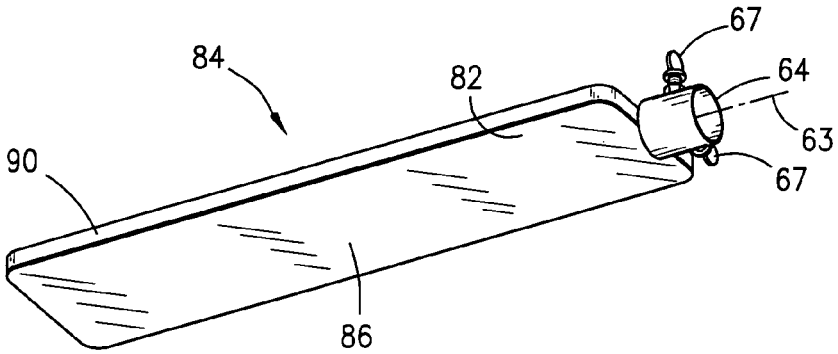

FIG. 8-10, In another embodiment of the disclosed invention, the return mechanism 51 (FIG. 1) may alternatively consist of a complete cylindrical structure 79, a triangular structure 80, or a facially flat planar structure 86.

What is claimed is:

1. A ball hitting practice apparatus comprising:

A rigid vertical shaft, with telescopic components, such that said vertical shaft can be extended, retracted, and locked into a desired length or position, with said vertical shaft having an upper first end and lower second end, wherein said lower second end is coupled to a weighted basal anchor that rests flat on a horizontal surface;

A rigid horizontal shaft, with telescopic components, such that said horizontal shaft can be extended, retracted, and locked into a desired length or position, with said horizontal shaft having a first end and a second end, wherein said horizontal shaft's first end is coupled by a hub mechanism, to the upper first end of the vertical shaft;

A horizontal acoustic return mechanism having a first end and a second end, coupled at said horizontal acoustic return mechanism's first end to the vertical shaft's upper first end, by a hinging mechanism that can be locked to secure the horizontal acoustic return mechanism in a desired position relative to the vertical shaft;

A cord having a first and second end that is tethered by said cord's second end to a cord dock affixed to the lower second end of the vertical shaft, wherein said cord runs upward from said cord dock, and across the horizontal shaft, such that said cord's first end hangs vertically downward from the second end of said horizontal shaft;

A ball that is tethered to the first end of the cord;

A rigid telescopic cylindrical casing, having a first end and a second end, wherein said telescopic cylindrical casing encases the portion of the cord that hangs vertically downward from the rigid horizontal shaft, said cord portion comprising specifically that length of the cord between the second end of the horizontal shaft and the ball;

A spring control mechanism that couples said telescopic cylindrical casing's upper first end to said rigid horizontal shaft's second end.

* * * * *